US010627101B2

(12) United States Patent
Lan

(10) Patent No.: US 10,627,101 B2
(45) Date of Patent: Apr. 21, 2020

(54) LED LIGHT

(71) Applicant: Shenzhen Guanke Technologies Co., Ltd., Shenzhen (CN)

(72) Inventor: Qing Lan, Shenzhen (CN)

(73) Assignee: Shenzhen Guanke Technologies Co., Ltd., Shenzhen (CN)

( * ) Notice: Subject to any disclaimer, the term of this patent is extended or adjusted under 35 U.S.C. 154(b) by 195 days.

(21) Appl. No.: 15/876,209

(22) Filed: Jan. 22, 2018

(65) Prior Publication Data

US 2019/0212005 A1 Jul. 11, 2019

(30) Foreign Application Priority Data

Jan. 10, 2018 (CN) ..... 2018 1 0022946

(51) Int. Cl.

| | |
|---|---|
| ***F21V 31/00*** | (2006.01) |
| ***F21V 21/30*** | (2006.01) |
| ***F21V 29/75*** | (2015.01) |
| ***F21V 23/00*** | (2015.01) |
| ***F21V 15/02*** | (2006.01) |
| *F21S 8/00* | (2006.01) |
| *F21Y 115/10* | (2016.01) |

(52) U.S. Cl.

CPC ..... *F21V 31/005* (2013.01); *F21V 15/02* (2013.01); *F21V 21/30* (2013.01); *F21V 23/001* (2013.01); *F21V 29/75* (2015.01); *F21Y 2115/10* (2016.08)

(58) Field of Classification Search

CPC ..... F21V 31/005; F21V 31/00; F21V 29/75; F21V 29/77; F21V 23/001; F21V 23/002; F21V 23/003; F21V 21/30; F21V 15/02; F21V 14/02; F21V 17/164; F21V 19/02; F21S 8/00; F21Y 2115/10

See application file for complete search history.

(56) References Cited

U.S. PATENT DOCUMENTS 1,556,403 A * 10/1925 Bissell ..... F21V 17/162 362/311.09

2012/0033415 A1* 2/2012 Sharrah ..... F21L 4/027 362/199

(Continued)

FOREIGN PATENT DOCUMENTS

CN 201435566 Y * 3/2010

CN 202111429 U * 1/2012

*Primary Examiner* — David V Bruce

(74) *Attorney, Agent, or Firm* — Maier & Maier, PLLC

(57) ABSTRACT

An LED light includes a housing, a mounting member and a body respectively mounted on two opposite ends of the housing to simultaneously obtain a vertical installation, a horizontal installation or an inclined installation. The mounting member includes a base, a connecting portion connected to the base and a first seal connected between the base and the connecting portion to waterproof the connecting portion. The housing includes a mounting portion, a supporting portion and a slot surrounded thereby. The mounting portion includes a first fixing bole and the connecting portion includes a corresponding second fixing hole and a rotating shaft passing through the first and second fixing holes in turn to rotate the connecting portion in the slot in a rotation angle range between 0 degree and 90 degree. The base includes four first inlets and a second inlet simultaneously perpendicular to the four first inlets thereby supporting a variety of connection modes.

20 Claims, 5 Drawing Sheets

(56) References Cited

U.S. PATENT DOCUMENTS

2012/0320594 A1* 12/2012 Chien ..... F21V 21/14
362/249.03
2017/0167695 A1* 6/2017 Erdener ..... F21V 14/06

* cited by examiner

LED LIGHT

BACKGROUND

1. Technical Field

The present disclosure generally relates to light sources field, and especially relates to a Light-Emitting Diode (LED) light.

2. Description of Related Art

It is well known that the LED light is gradually recognized and widely used in the market as a new energy-saving and environment-protection lighting product. In the process of continuous development from the conventional lamp to the LED light, a plurality of illuminations with new installation methods and new functions are derived. However, the traditional illuminations used in the market usually have the problem that the installation surface of the illuminations is limited. For example, the illuminations usually can only be installed on a horizontal surface or a vertical surface, or a variety of installation surfaces provided by a supporting frame, which is very inconvenient. Furthermore, the traditional illuminations used in the market are characterized that the angle of the luminescent surface is not adjustable, the connection mode is single and is not waterproof. A new LED light of the present disclosure is provided which may simultaneously and easy obtain a vertical installation, a horizontal installation or an inclined installation. Thus, it is very suitable for mounting on vertical walls, ceilings, horizontal platforms and sloping surfaces. In addition, the angle of the luminescent surface can be also adjustable to improve the luminescent range, which can meet the need of upward illumination, downward illumination and inclined illumination. Meanwhile, a wiring box structure of the LED light is provided to support a variety of wire connection modes and with good waterproof performance, thereby improving the safe grade of the product.

SUMMARY

The disclosure relates to an LED light which may simultaneously and easy obtain a vertical installation, a horizontal installation and an inclined installation, support a variety of wire connection modes and optionally adjust the light angle of the LED light.

In one aspect, an LED light includes: a housing, a mounting member connected to an upper end of the housing, and a body connected to an opposite bottom end of the housing. The mounting member includes a base, a connecting portion fixed with the base and a first seal connected between the base and the connecting portion. The housing includes a mounting portion, a supporting portion perpendicular to the mounting portion, and a slot surrounded by the mounting portion and the supporting portion. The mounting portion includes a first fixing hole. The connecting portion includes a second fixing hole corresponding to the first fixing hole, and a rotating shaft passing through the first fixing hole and the second fixing hole in turn. The connecting portion can rotate in the slot via the rotating shaft in a rotation angle range between 0 degree and 90 degree so that a light angle of the body can be adjusted according to the rotation of the connecting portion. The base includes four first inlets arranged on a side surface at interval and a second inlet simultaneously perpendicular to the four first inlets.

Wherein the base further includes a plurality of tarpaulins respectively fastened with the four first inlets and the second inlet, and a pair of ears formed with a symmetrical mode and horizontally extending outward along the radial direction of the base; the pair of ears and the second inlet formed on the bottom of the base, and the base further includes a plurality of first strengthening ribs uniformly arranged on the bottom of the base and a plurality of outlets arranged at interval, together with the plurality of first strengthening ribs.

Wherein the connecting portion includes a recess for receiving the first seal therein, and a plurality of arc-shaped second strengthening ribs uniformly arranged at interval, the base is tightly passed on the first seal when the base connects to the connecting portion.

Wherein the connecting portion further includes a sleeve sleeving on the rotating shaft to wrap around the outer surface of the rotating shaft and passing through the first fixing hole and the second fixing hole in turn.

Wherein a pair of overline slots is respectively formed on two sides of the sleeve along an axial direction of the rotating shaft and inclined to the axis of the rotating shaft; the connecting portion further includes a wire passing through the pair of overline slots so that one end of the wire is electrically connected with a power supply received in the housing and the other end is received in the base.

Wherein the connecting portion further includes a second seal, a third seal and a fourth seal connected between the mounting portion and the connecting portion, the second seal and the third seal respectively sleeved on two opposite ends of the rotating shaft; the second seal snapped and sealed with the first fixing hole and the third seal snapped and sealed with the second fixing hole when the rotating shaft passing through the first and second fixing holes in turn.

Wherein the sleeve further includes a positioning block formed thereof along the axial direction of the rotating shaft, and the connecting portion includes a sliding groove, the positioning block inserting into the sliding groove to fasten the sleeve with the connecting portion.

Wherein the LED light further includes a protecting case positioned on the bottom of the housing and tightly wrapped around the body, the body includes a heat sink, a plurality of first LED panels respectively formed on the side of the heat sink, and a second LED panel formed on the bottom of the heat sink.

Wherein the heat sink includes a hollow-cylindrical-shaped cooling post, a plurality of cooling plates uniformly extending outward along the radial direction of the cooling post and inserting into the cooling post, and a plurality of cooling units uniformly arranged between any two adjacent cooling plates at interval and connected to the cooling post.

Wherein the housing further includes a driving power base plate received therein and electrically connected to the power supply; the driving power base plate includes a wiring hole so that the wire passing through the wiring hole and electrically connecting to the power supply; a waterproof case is wrapped around the body and includes a waterproof slot for preventing water from entering the body.

Wherein the mounting member can be installed with the housing by a fixed way selected from one of a vertical installation, a horizontal installation and an inclined installation.

In another aspect, an LED light according to an exemplary embodiment of the present disclosure includes a housing, a mounting member connected to an end of the housing, and a body connected to an opposite end of the housing. The mounting member includes a hollow-cylindrical-shaped base, an approximately fan-shaped connecting portion fixed with the base and a first disc-shaped seal connected between the base and the connecting portion. The base includes four first inlets arranged on a side surface thereof at interval and a second inlet formed on the middle portion thereof along the radial direction of the base and simultaneously perpendicular to the four first inlets. The housing includes a hollow-disc-shaped base portion, a mounting portion perpendicularly extending upward from the middle of the base portion, a supporting portion perpendicular to the mounting portion, and a slot surrounded by the mounting portion and the supporting portion. A first fixing hole is formed at the upper portion of the mounting portion along its horizontal direction. The connecting portion includes a first end rotatably connected to the mounting portion and an approximately fan-shaped second end extending from a side of the first end. The first end includes a second fixing hole corresponding to the first fixing hole, and a rotating shaft passing through the first fixing hole and the second fixing hole in turn. The connecting portion can rotate in the slot via the rotating shaft in a rotation angle range between 0 degree and 90 degree so that a light angle of the body can be adjusted according to the rotation of the connecting portion.

Wherein the mounting member can be installed with the housing by a fixed way selected from one of a vertical installation, a horizontal installation and an inclined installation Wherein the base further includes a plurality of tarpaulins respectively fastened with the four first inlets and the second inlet, and a pair of ears formed with a symmetrical mode and horizontally extending outward along the radial direction of the base; the pair of ears and the second inlet formed on the bottom of the base, and the base further includes a plurality of first strengthening ribs uniformly arranged on the bottom of the base and a plurality of outlets arranged at interval, together with the plurality of first strengthening ribs.

Wherein the connecting portion further includes a second seal, a third seal and a fourth seal connected between the mounting portion and the connecting portion, the second seal and the third seal respectively sleeved on two opposite ends of the rotating shaft; the second seal snapped and sealed with the first fixing hole and the third seal snapped and sealed with the second fixing hole when the rotating shaft passing through the first and second fixing holes in turn.

Wherein the second end further includes a recess formed in the inner surface thereof for receiving the first seal therein, and a plurality of arc-shaped second strengthening ribs uniformly arranged at interval, and the base is tightly pressed on the first seal when the base connects to the connecting portion; the first end further includes a sleeve sleeving on the rotating shaft to wrap around the outer surface of the rotating shaft and passing through the first fixing hole and the second fixing hole in turn.

Wherein a pair of overline slots is respectively formed on two sides of the sleeve along an axial direction of the rotating shaft and inclined to the axis of the rotating shaft; the connecting portion further includes a wire passing through the pair of overline slots so that one end of the wire is electrically connected with a power supply received in the housing and the other end is received in the base; the sleeve further includes a positioning block formed thereof along the axial direction of the rotating shaft, and the connecting portion includes a sliding groove, the positioning block inserting into the sliding groove to fasten the sleeve with the connecting portion.

Wherein the housing further includes a driving power base plate received therein and electrically connected to the power supply, the driving power base plate includes a wiring hole so that the wire passing through the wiring hole and electrically connecting to the power supply; a waterproof case is wrapped around the body and includes a waterproof slot for preventing water from entering the body.

Wherein the LED light further includes a protecting case positioned on the bottom of the housing and tightly wrapped around the body; the body includes a heat sink, a plurality of first LED panels respectively formed on the side of the heat sink, and a second LED panel formed on the bottom of the heat sink.

Wherein the heat sink includes a hollow-cylindrical-shaped cooling post, a plurality of cooling plates uniformly extending outward along the radial direction of the cooling post and passing into the cooling post, and a plurality of cooling units uniformly arranged between any two adjacent cooling plates at interval and connected to the cooling post.

The present disclosure provides the advantages as below.

The LED light includes a housing, a mounting member and a body respectively mounted on two opposite ends of the housing to simultaneously obtain a vertical installation, a horizontal installation and an inclined installation. The mounting member includes a base, a connecting portion connected to the base and a first seal connected between the base and the connecting portion to waterproof the connecting portion. The housing includes a mounting portion, a supporting portion and a slot surrounded by the mounting portion and the supporting portion. The mounting portion includes a first fixing hole and the connecting portion includes a corresponding second fixing hole and a rotating shaft passing through the first and second fixing holes in turn to rotate the connecting portion in the slot with a rotation angle range between 0 degree and 90 degree. The base includes four first inlets and a second inlet simultaneously perpendicular to the four first inlets, thereby supporting a variety of connection modes.

DETAILED DESCRIPTION

Figure 1:
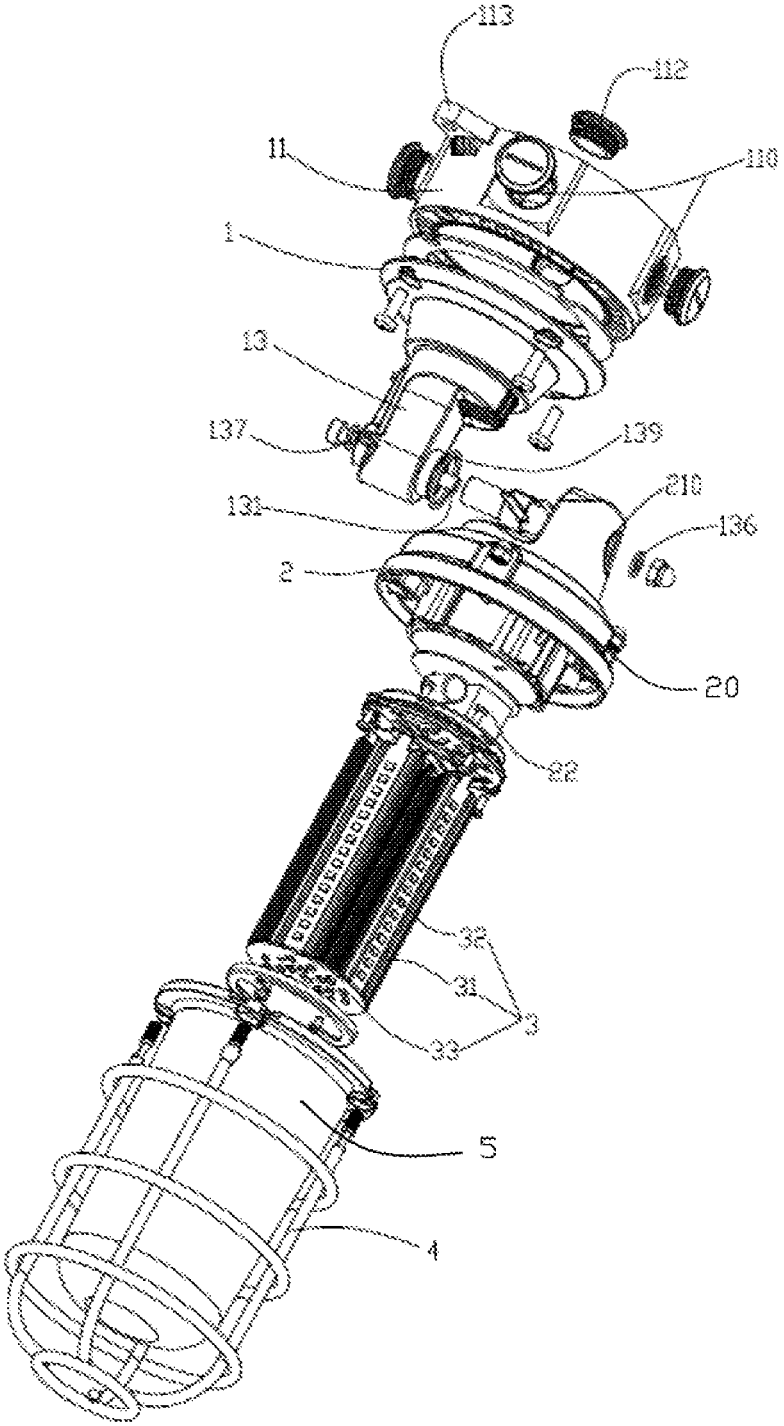
FIG. 1 is an exploded schematic view of the LED light in accordance with an exemplary embodiment.

The disclosure is illustrated by way of example and not by way of limitation in the figures of the accompanying drawings, in which like reference numerals indicate similar elements.

Figure 2:
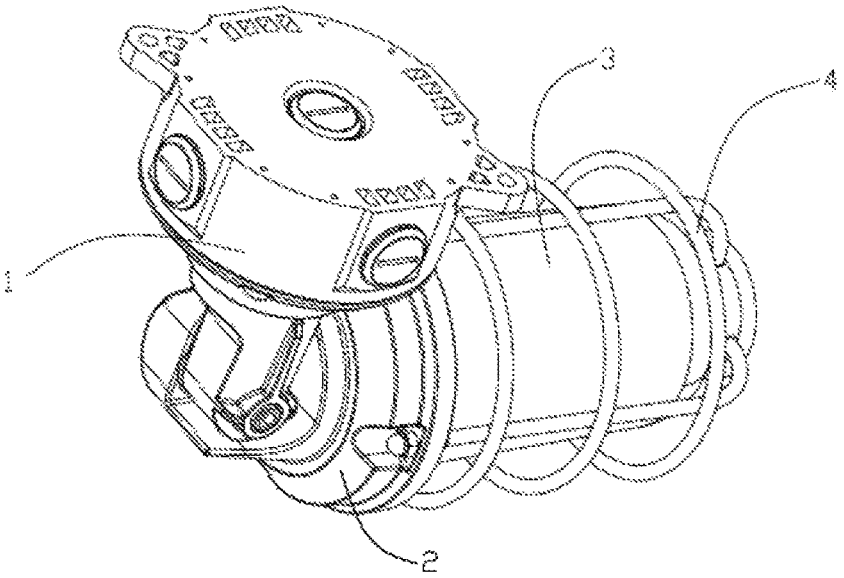
FIG. 2 is an assembly schematic view of a body and a mounting member of the LED light of FIG. 1, shown the body vertically installed on the mounting member.
Figure 3:
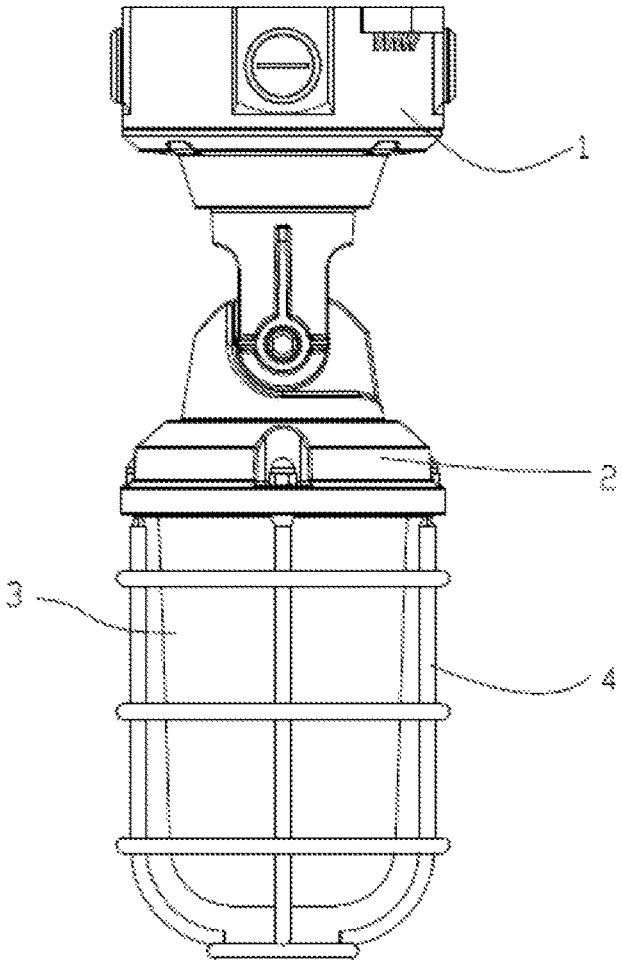
FIG. 3 is similar to FIG. 2, but shown the body horizontally installed on the mounting member.
Figure 4:
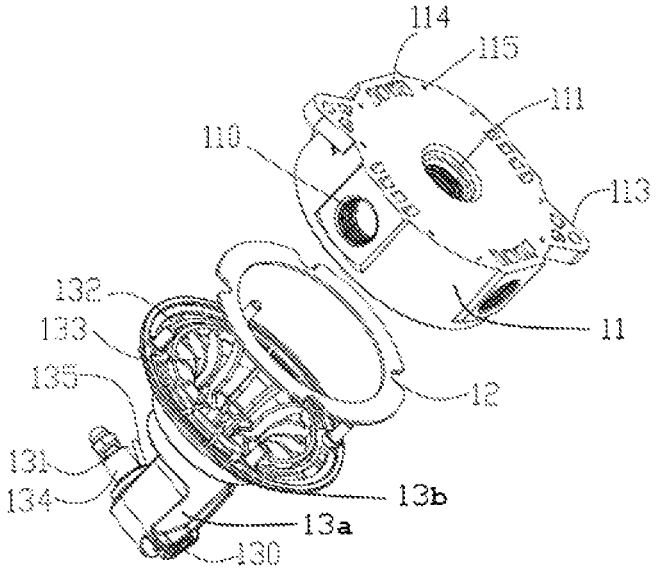
FIG. 4 is an exploded schematic view of the mounting member of the LED light of FIG. 1.
Figure 5:
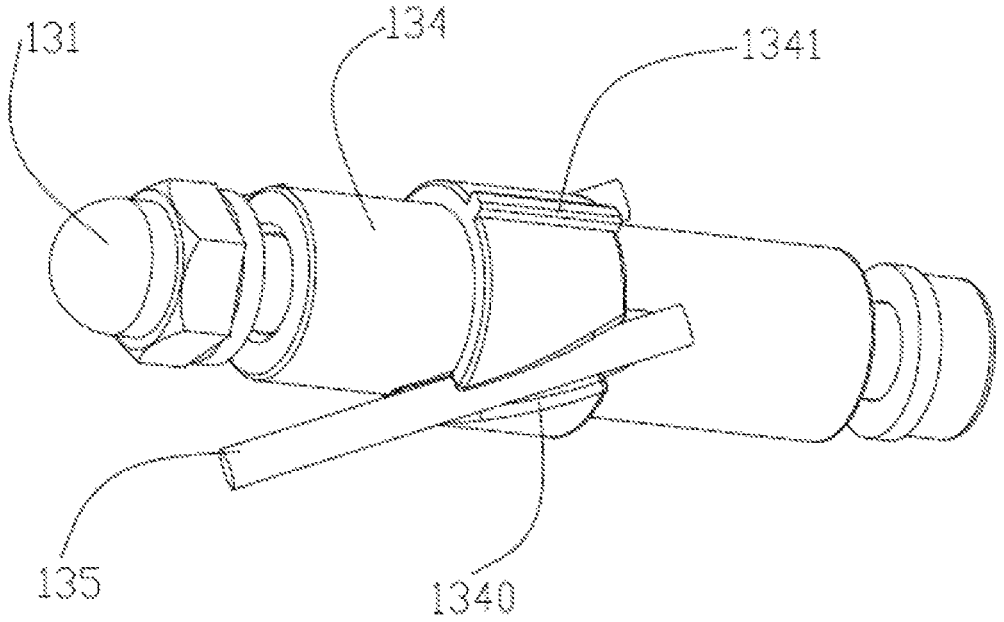
FIG. 5 is an assembly schematic view of a rotating shaft and a sleeve of the LED light of FIG. 1.
Figure 6:
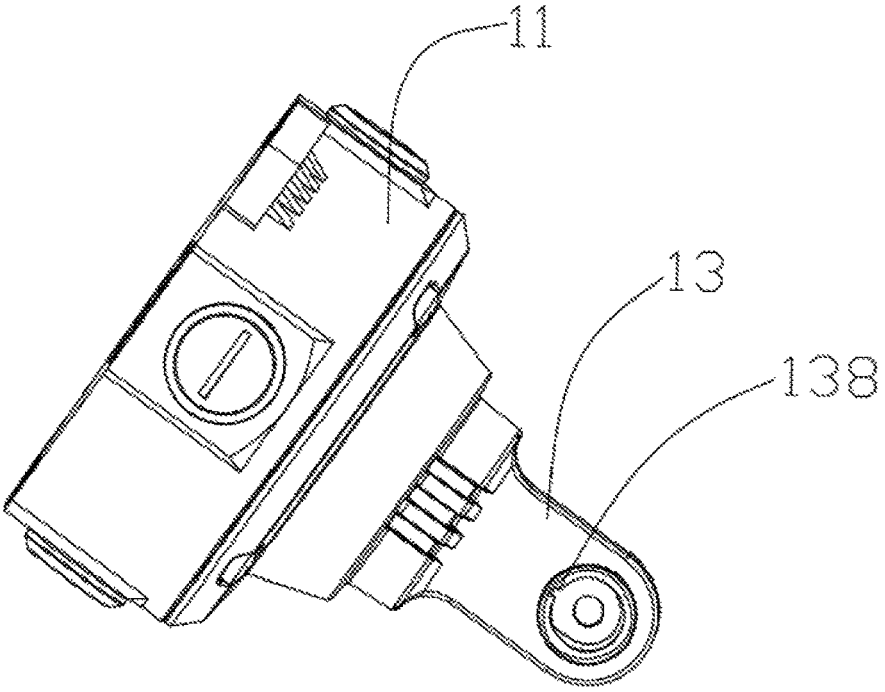
FIG. 6 is an assembly schematic view of the mounting member of the LED light of FIG. 1.
Figure 7:
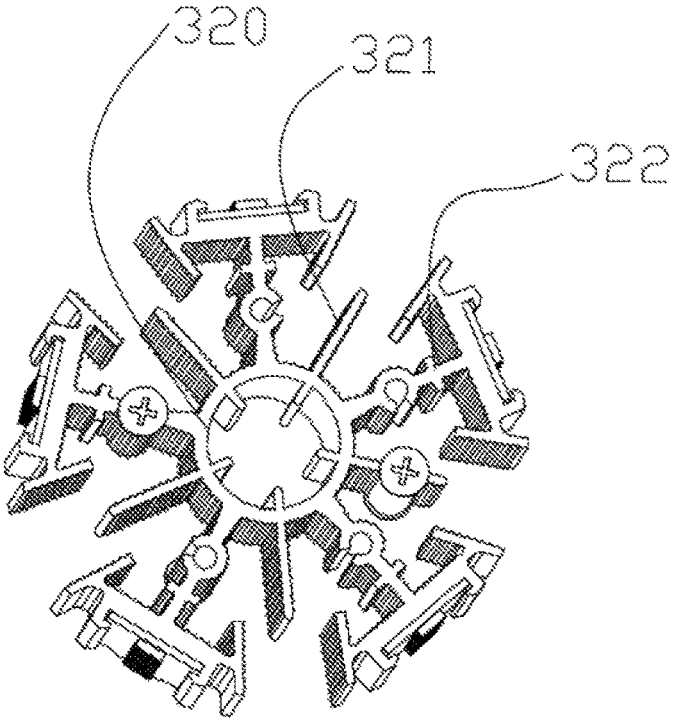
FIG. 7 is a schematic view of a heat sink of the LED light of FIG. 1.
Figure 8:
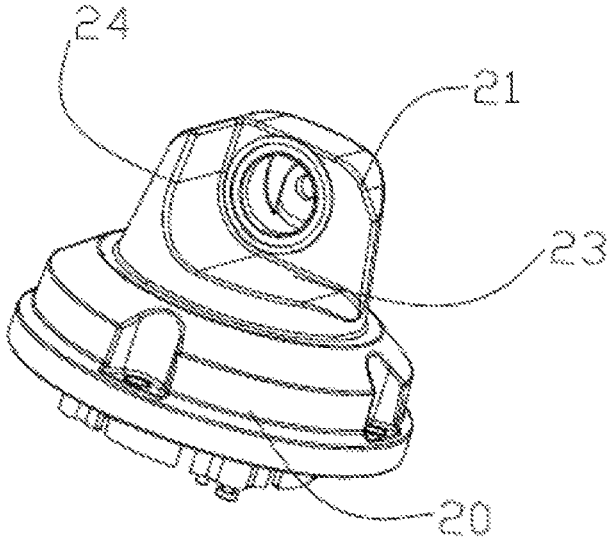
FIG. 8 is a schematic view of a housing of the LED light of FIG. 1.
Figure 9:
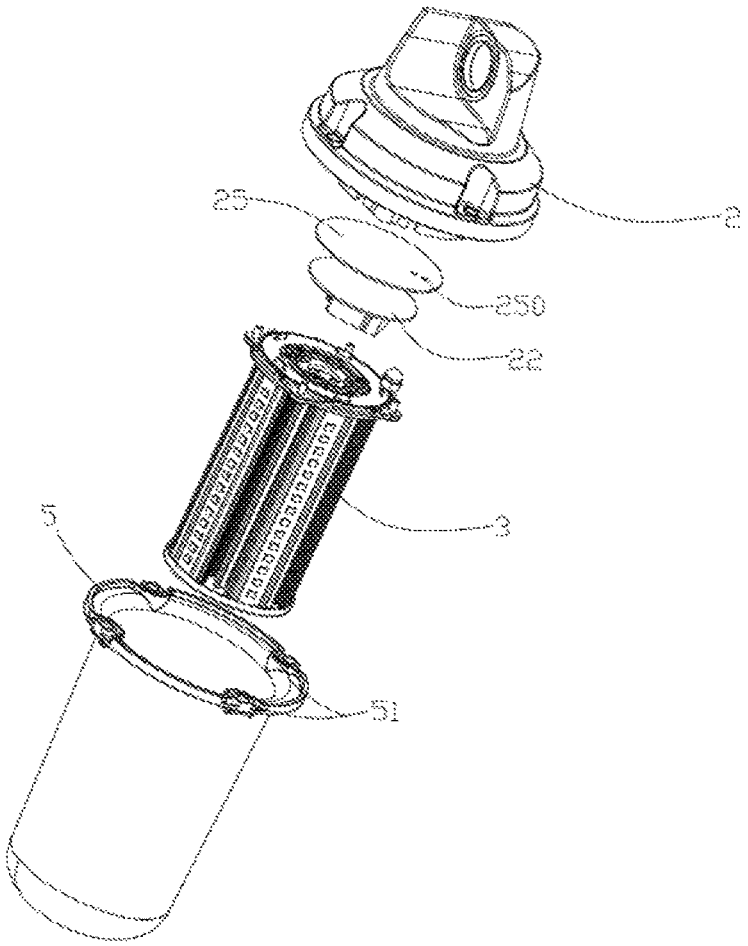
FIG. 9 is a partial exploded schematic view of the LED light of FIG. 1, but focused on showing the structure of the body and the housing.

Referring to FIGS. 1-9, the LED light according to an exemplary embodiment includes a mounting member 1, a housing 2, a body 3, a protecting case 4 and a waterproof case 5. The mounting member 1 is connected to an upper end of the housing 2, and the body 3 is connected to a bottom end of the housing 2 and received in the waterproof case 5. The protecting case 4 is wrapped around the waterproof case 5 so that both the protecting case 4 and the waterproof case 5 are connected to the bottom end of the housing 2. The mounting member 1 includes a hollow-cylindrical-shaped base 11, an approximately fan-shaped connecting portion 13 fixed with the base 11 and a first disc-shaped seal 12 connected between the base 11 and the connecting portion 13. The housing 2 includes a hollow-disc-shaped base portion 20, a mounting portion 21 perpendicularly extending upward from the middle of the base portion 20, a supporting portion 24 perpendicular to the mounting portion 21, and a slot 23 surrounded by the mounting portion 21 and the supporting portion 24. A first fixing hole 210 is formed at the upper portion of the mounting portion 21 along a horizontal direction thereof. The connecting portion 13 includes a first end 13*a* rotatably connected to the mounting portion 21 and an approximately fan-shaped second end 13*b* extending downward from a side of the first end 13*a*. The first end 13*a* includes a second fixing hole 130 corresponding to the first fixing hole 210, and a rotating shaft 131 passing through the first fixing hole 210 and the second fixing hole 130 in turn. The connecting portion 13 can rotate in the slot 23 via the rotating shaft 131 in a rotation angle range between 0 degree and 90 degree so that a light angle of the body 3 can be adjusted according to the rotation of the connecting portion 13. The base 11 includes four first inlets 110 arranged on a side surface thereof at interval and a second inlet 111 formed on the middle portion thereof along the radial direction of the base 11 and simultaneously perpendicular to the four first inlets 110.

In the exemplary embodiment of the present disclosure, the housing 2 and the body 3 are connected with each other by a threaded connection, which is stably fixed therebetween without affecting the overall appearance of the LED light.

In the exemplary embodiment of the present disclosure, the first seal 12 is an elastic plastic element and sandwiched between the base 11 and the second end 13*b* of the connecting portion 13, thereby the leak tightness between the base 11 and the connecting portion 13 can be ensured. Simultaneously, the first seal 12 is provided to avoid the external moisture from the base 11 enter the connecting portion 13 to corrode the internal wire of the connecting portion 13, thereby poor internal connection performance of the LED light is avoided. So, the LED light is waterproof which can not only be used in dry environment, but also can normally work in humid environment, thereby it is more widely used and more popular in the market.

In the exemplary embodiment of the present disclosure, the mounting member 1 is provided for mounting the LED light on the external structure and supporting the rotation of the rotating shaft 131 to ensure the body 3 also rotate with the base 11. When the LED light is mounted on a fixing device (not shown), the light angle of the body 3 can be still adjusted so that the mounting member 1 can achieve a variety of installation modes such as a horizontal installation, a vertical downward installation, a vertical upward installation and an inclined installation, thereby the implementation of the vertical installation, the horizontal installation and the inclined installation makes the installation of the LED light more convenient and more suitable for the environment.

In the exemplary embodiment of the present disclosure, the slot 23 is designed for providing a rotation space to the connecting portion 13. After fixing the mounting member 1, because of the rotation function of the rotating shaft 131, the angle of the body 3 can be manually adjusted so that the light angle of the LED light is also adjusted. The connecting portion 13 can rotate in the slot 23 with an rotate angle between 0 degree and 90 degree, thereby the adjustable angle of the body 3 is also between 0 degree and 90 degree. When the connecting portion 13 is rotated to resist against the supporting portion 24, the angle formed between the body 3 and the mounting member 1 is 0 degree. Otherwise, when the connecting portion 13 is rotated to resist against the bottom of the slot 23, the angle formed between the body 3 and the mounting member 1 is 90 degree. That is to say, when the connecting portion 13 is rotated to resist against the bottom of the slot 23, the body 3 is perpendicular to the mounting member 1.

In the exemplary embodiment of the present disclosure, the base 11 includes four first inlets 110 arranged on a side surface at interval and a second inlet 111, and the side surface of the base 11 is cylindrical. The angle between any two adjacent first inlets 110 is 90 degree, and the second inlet 111 formed on the bottom thereof along the radial direction of the base 11. The cross-section of the four first inlets 110 and the second inlet 111 all are circular, and the four first inlets 110 and the second inlet 111 are provided for electrically connecting the LED light and the external wire, which provides electronic power as turning on or turning off the LED light. After assembling the mounting member 1, at least one from the four first inlets 110 and the second inlet 111 can be chosen to connect with the wire according to the actual situation, thereby the connection modes of a variety of lamps and lanterns are obtained and then the inconvenient problem of multi-line traces can be avoided.

Furthermore, the base 11 further includes a plurality of tarpaulins 112 respectively fastened with the four first inlets 110 and the second inlet 111, and a pair of ears 113 formed with a symmetrical mode and horizontally extending outward along the radial direction of the base 11. The pair of ears 113 provided for external installation of the LED light and the second inlet 111 are formed on the bottom of the base 11. The base 11 further includes a plurality of first strengthening ribs 114 uniformly arranged on the bottom of the base 11 and a plurality of outlets 115 arranged at interval, together with the plurality of first strengthening ribs 114.

In the exemplary embodiment of the present disclosure, when the wire is chosen to insert into one of the four first inlets 110 and the second inlet 111, the tarpaulin 112 is covered on the chosen one inlet to avoid external moisture entering the base 11. The plurality of tarpaulins 112 is provided for respectively fastening with the four first inlets 110 and the second inlet 111 to further improve the waterproof performance of the LED light, and make the appearance of LED light more beautiful. Each of the four first inlets 110, the second inlet 111 and the plurality of tarpaulins 112 defines thread, thereby the connection therebetween the four first inlets 110, the second inlet 111 and the plurality of tarpaulins 112 is more stable via threaded connection.

In the exemplary embodiment of the present disclosure, a pair of symmetrical ears 113 is set at the bottom of the base 11, thereby the force applied on the LED light is uniform after the LED light is installed. The pair of ears 113 is extended outward from the sidewall of the base 11 and engaged with screws to obtain the external installation of the LED light.

In the exemplary embodiment of the present disclosure, the base 11 further includes a plurality of first strengthening ribs 114 and a plurality of outlets 115. The plurality of first strengthening ribs 114 and the plurality of outlets 115 are uniformly arranged at interval on the bottom of the base 11, thereby the structure of the base 11 is stronger to withstand heavier loads and the waterproof performance of the base 11 is further strengthened.

Furthermore, the second end 13*b* of the connecting portion 13 includes a recess 132 formed in the inner wall thereof for receiving the first seal 12 therein. When the base 11 is fastened with the connecting portion 13, the base 11 is tightly pressed on the first seal 12, thereby improve the leak tightness between the base 11 and the connecting portion 13.

Furthermore, the second end 13*b* of the connecting portion 13 also includes a plurality of arc-shaped second strengthening ribs 133 uniformly arranged in the inner wall at interval, thereby the structure of the connecting part 13 is more stable. In normal use, the mechanical fracture can be avoided to improve the lifespan and the quality of the LED light.

Furthermore, the first end 13*a* of the connecting portion 13 further includes a sleeve 134 sleeving on the rotating shaft 131 to wrap around the outer surface of the rotating shaft 131 and passing through the first fixing hole 210 and the second fixing hole 130 in turn.

In the exemplary embodiment of the present disclosure, when the rotating shaft 131 rotates, the sleeve 134 is followed to rotate. In this way, the sleeve 134 can protect the rotating shaft 131 from excessive wear, and increase the damping of the rotating shaft 131, thereby the body 3 can stop in any angle between 0 degree and 90 degree rather than in the endpoint values. The sleeve 134 is an insulative sleeve.

Furthermore, a pair of overline slots 1340 is respectively formed on two sides of the sleeve 134 along an axial direction of the rotating shaft 131 and inclined to the axis of the rotating shaft 131. The connecting portion 13 further includes a wire 135 passing through the pair of overline slots 1340 so that one end of the wire 135 is electrically connected with a power supply 22 received in the housing 2 and the other end is received in the base 11.

In the exemplary embodiment of the present disclosure, the power supply 22 is configured for controlling the LED light to turn on or turn off. An electrical connection is formed between the power supply 22 and the outer conducting wire set in the base 11 by the wire 135, the overline slot 1340 is inclined to receive the wire 135 therein. When the rotating shaft 131 and the sleeve 134 rotate, the wire 135 is followed to rotate. Thus, the overline slot 1340 is necessary to reserve a certain sufficient space to facilitate the outer wire 135 rotating in the overline slot 1340. In other embodiments, a wiring hole can be designed for tranvelling the wire 135.

Furthermore, the connecting portion 13 further includes a second seal 136, a third seal 137 and a fourth seal 139 connected between the mounting portion 21 and the first end 13*a* of the connecting portion 13. Use second seal 136 and the third seal 137 are respectively sleeved on two opposite ends of the rotating shaft 131. The second seal 136 is snapped and sealed with the first fixing hole 210 and the third seal 137 is snapped and sealed with the second fixing hole 130 when the rotating shaft 131 passes through the fast fixing hole 210 and the second fixing hole 130 in turn.

In the exemplary embodiment of the present disclosure, after assembly, the second seal 136, the third seal 137 and the fourth seal 139 are parallel to each other. The fourth seal 139 is sandwiched between the mounting portion 21 and the first end 13*a*, and the second seal 136 and the third seal 137 are respectively sleeved on two opposite ends of the rotating shaft 131. In this way, water can be prevented from enter the connecting portion 13 to affect the electrical connection of the wire 135 therein, which further improves the waterproof performance of the LED light.

Furthermore, the sleeve 134 further includes a positioning block 1341 formed thereof along the axial direction of the rotating shaft 131. The connecting portion 13 includes a sliding groove 138 formed on the first end 13*a*. The positioning block 1341 is inserted into the sliding groove 138 to fasten the sleeve 134 with the connecting portion 13.

In the exemplary embodiment of the present disclosure, when installing the sleeve 134, the positioning block 1341 slides in the sliding groove 138, thereby the sleeve 134 can be accurately positioned in the connecting portion 13.

Furthermore, the protecting case 4 is positioned on the bottom of the housing 2 and tightly wrapped around the body 3. The body 3 includes a heat sink 31, a plurality of first LED panels 32 uniformly formed on the side of the heat sink 31, and a second LED panel 33 formed on the bottom of the heat sink 31.

In the exemplary embodiment of the present disclosure, the protecting case 4 is a metal mesh and covers onto the outer of the body 3 to protect the body 3 from falling, anti-falling or anti-collision. It is can be understood, in other embodiments, the protecting case 4 can be omitted.

In the exemplary embodiment of the present disclosure, the heat sink 31 is columnar, the plurality of first LED panels 32 is arranged in 360 degree and uniformly formed on the side of the heat sink 31, and the second LED panel 33 is formed on the bottom of the heat sink 31. In this way, the LED light of the present disclosure has a much larger luminous angle and a wider range of applicability.

Furthermore, the heat sink 31 includes a hollow-cylindrical-shaped cooling post 320, a plurality of cooling plates 321 uniformly extending outward along the radial direction of the cooling post 320 and inserting into the cooling post 320, and a plurality of cooling units 322 uniformly arranged between any two adjacent cooling plates 321 at interval and connected to the cooling post 320.

In the exemplary embodiment of the present disclosure, a plurality of cooling holes (not shown) are formed among the cooling post 320, the cooling plate 321 and the cooling unit 322 for air convection, which increases the efficiency of the heat dissipation. The interior of the cooling post 320 is hollow for inserting the cooling plates 321 therein, thereby the heat dissipation area of the heat sink 31 is further increased to improve the heat dissipation efficiency of the heat sink 31. Both the cooling plate 321 and the cooling unit 322 connect to the cooling post 320, thereby the internal structure of the heat sink 31 is neat and beautiful, with good heat dissipation performance.

Furthermore, the housing 2 further includes a driving power base plate 25 received in the base portion 20 and electrically connected to the power supply 22. The driving power base plate 25 includes a wiring hole 250 so that the wire 135 passes through the wiring hole 250 and electrically connects to the power supply 22. The waterproof case 5 is wrapped around the body 3 and includes a waterproof slot 51 for waterproofing the water into the body 5.

In the exemplary embodiment of the present disclosure, the power supply 22 and the driving power base plate 25 are fixed-connected to each other, and the power supply 22 is located below the driving power base plate 25. Simultaneously, the driving power base plate 25 is covered onto the open end of the base portion 20. The wiring holes 250 are provided for allowing the wires 135 pass therethrough to electrically connect to the power supply 22. In this way, water can be prevented from entering the housing 2 to affect the power device 22, thereby further improving the waterproof performance of the LED light.

In the exemplary embodiment of the present disclosure, the waterproof case 5 is a light-transparent structure to receive the body 3 therein and includes the waterproof slot 51 thereon. In this way, the external moisture can be prevented from entering the body 3 to further improve the waterproof performance of the LED light.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. An LED light comprising:

a housing comprising a mounting portion, a supporting portion perpendicular to the mounting portion, and a slot surrounded by the mounting portion and the supporting portion, the mounting portion comprising a first fixing hole;

a mounting member connected to an upper end of the housing and comprising a base, an approximately fan-shaped connecting portion fixed with the base and a first seal connected between the base and the connecting portion, the base comprising four first inlets arranged on a side surface at interval and a second inlet simultaneously perpendicular to the first four inlets, the connecting portion comprising a second fixing hole corresponding to the first fixing hole, and a rotating shaft passing through the first fixing hole and the second fixing hole in turn;

a body connected to an opposite bottom end of the housing; and wherein the connecting portion can rotate in the slot via the rotating shaft, with a rotation angle range between 0 degree and 90 degree, so that a light angle of the body can be adjusted according to the rotation of the connecting portion.

2. The LED light as claimed in claim 1, wherein the base further comprises a plurality of tarpaulins respectively fastened with the four first inlets and the second inlet, and a pair of ears formed with a symmetrical mode and horizontally extending outward along the radial direction of the base; the pair of ears and the second inlet formed on the bottom of the base, and the base further comprises a plurality of first strengthening ribs uniformly arranged on the bottom of the base and a plurality of outlets arranged at interval, together with the plurality of first strengthening ribs.

3. The LED light as claimed in claim 1, wherein the connecting portion comprises a recess for receiving the first seal therein, and a plurality of arc-shaped second strengthening ribs uniformly arranged at interval, the base is tightly pressed on the first seal when the base connects to the connecting portion.

4. The LED light as claimed in claim 1, wherein the connecting portion further comprises a sleeve sleeving on the rotating shaft to wrap around the outer surface of the rotating shaft and passing through the first fixing hole and the second fixing hole in turn.

5. The LED light as claimed in claim 4, wherein a pair of over-line slots is respectively formed on two sides of the sleeve along an axial direction of the rotating shaft and inclined to the axis of the rotating shaft, the connecting portion further comprises a wire passing through the pair of over-line slots so that one end of the wire is electrically connected with a power supply received in the housing and the other end is received in the base.

6. The LED light as claimed in claim 4, wherein the connecting portion further comprises a second seal, a third seal, and a fourth seal connected between the mounting portion and the connecting portion, the second seal and the third seal respectively sleeved on two opposite ends of the rotating shaft; the second seal snapped and sealed with the first fixing hole and the third seal snapped and sealed with the second fixing hole when the rotating shaft passing through the first and second fixing holes in turn.

7. The LED light as claimed in claim 4, wherein the sleeve further comprises a positioning block formed thereof along the axial direction of the rotating shaft, and the connecting portion comprises a sliding groove, the positioning block inserting into the sliding groove to fasten the sleeve with the connecting portion.

8. The LED light as claimed in claim 1, wherein the LED light further comprises a protecting case positioned on the bottom of the housing and tightly wrapped around the body; the body comprises a heat sink, a plurality of first LED panels respectively formed on the side of the heat sink, and a second LED panel formed on the bottom of the heat sink.

9. The LED light as claimed in claim 8, wherein the heat sink comprises a hollow-cylindrical-shaped cooling post, a plurality of cooling plates uniformly extending outward along the radial direction of the cooling post and inserting into the cooling post, and a plurality of cooling units uniformly arranged between any two adjacent cooling plates at interval and connected to the cooling post.

10. The LED light as claimed in claim 5, wherein the housing further comprises a driving power base plate received therein and electrically connected to the power supply, the driving power base plate comprises a wiring hole so that the wire passing through the wiring hole and electrically connecting to the power supply; a waterproof case is wrapped around the body and comprises a waterproof slot for preventing water from entering the body.

11. The LED light as claimed in claim 1, wherein the mounting member can be installed with the housing by a fixed way selected from one of a vertical installation, a horizontal installation, and an inclined installation.

12. An LED light comprising:

a housing comprising a hollow-disc-shaped base portion, a mounting portion perpendicularly extending upward from the middle of the base portion, a supporting portion perpendicular to the mounting portion, and a slot surrounded by the mounting portion and the supporting portion, a first fixing hole formed at the upper portion of the mounting portion along its horizontal direction;

a mounting member connected to an end of the housing and comprising a hollow-cylindrical-shaped base, an approximately fan-shaped connecting portion fixed with the base and a first disc-shaped seal connected between the base and the connecting portion; the base comprising four first inlets arranged on a side surface thereof at interval and a second inlet formed on the middle portion thereof along the radial direction of the base and simultaneously perpendicular to the four first inlets; the connecting portion comprising a first end rotatably connected to the mounting portion and an approximately fan-shaped second end extending from a side of the first end; the first end comprising a second fixing hole corresponding to the first fixing hole, and a rotating shaft passing through the first fixing hole and the second fixing hole in turn;

a body connected to an opposite end of the housing; and wherein the connecting portion can rotate in the slot via the rotating shaft, with a rotation angle range between 0 degrees and 90 degrees, so that a light angle of the body can be adjusted according to the rotation of the connecting portion.

13. The LED light as claimed in claim 12, wherein the mounting member can be installed with the housing by a fixed way selected from one of a vertical installation, a horizontal installation, and an inclined installation.

14. The LED light as claimed in claim 12, wherein the base further comprises a plurality of tarpaulins respectively fastened with the four first inlets and the second inlet, and a pair of ears formed with a symmetrical mode and horizontally extending outward along the radial direction of the base; the pair of ears and the second inlet formed on the bottom of the base, and the base further comprises a plurality of first strengthening ribs uniformly arranged on the bottom of the base and a plurality of outlets arranged at interval, together with the plurality of first strengthening ribs.

15. The LED light as claimed in claim 12, wherein the connecting portion further comprises a second seal, a third seal, and a fourth seal connected between the mounting portion and the connecting portion, the second seal and the third seal respectively sleeved on two opposite ends of the rotating shaft; the second seal snapped and sealed with the first fixing hole and the third seal snapped and sealed with the second fixing hole when the rotating shaft passing through the first and second fixing holes in turn.

16. The LED light as claimed in claim 12, wherein the second end further comprises a recess formed in the inner surface thereof for receiving the first seal therein, and a plurality of arc-shaped second strengthening ribs uniformly arranged at interval, and the base is tightly pressed on the first seal when the base connects to the connecting portion; the first end further comprises a sleeve sleeving on the rotating shaft to wrap around the outer surface of the rotating shaft and passing through the first fixing hole and the second fixing hole in turn.

17. The LED light as claimed in claim 16, wherein a pair of over-line slots is respectively formed on two sides of the sleeve along an axial direction of the rotating shaft and inclined to the axis of the rotating haft; the connecting portion further comprises a wire passing through the pair of over-line slots so that one end of the wire is electrically connected with a power supply received in the housing and the other end is received in the base; the sleeve further comprises a positioning block formed thereof along the axial direction of the rotating shaft, and the connecting portion comprises a sliding groove, the positioning block inserting into the sliding groove to fasten the sleeve with the connecting portion.

18. The LED light as claimed in claim 17, wherein the housing further comprises a driving power base plate received therein and electrically connected to the power supply, the driving power base plate comprises a wiring hole so that the wire passing through the wiring hole and electrically connecting to the power supply; a waterproof case is wrapped around the body and comprises a waterproof slot for preventing water from entering the body.

19. The LED light as claimed in claim 12, wherein the LED light further comprises a protecting case positioned on the bottom of the housing and tightly wrapped around the body; the body comprises a heat sink, a plurality of first LED panels respectively formed on the side of the heat sink, and a second LED panel formed on the bottom of the heat sink.

20. The LED light as claimed in claim 19, wherein the heat sink comprises a hollow-cylindrical-shaped cooling post, a plurality of cooling plates uniformly extending outward along the radial direction of the cooling post and inserting into the cooling post, and a plurality of cooling units uniformly arranged between any two adjacent cooling plates at interval and connected to the cooling post.

* * * * *